United States Patent [19]

McKee et al.

[11] Patent Number: 4,656,444

[45] Date of Patent: Apr. 7, 1987

[54] CIRCUIT BREAKER WITH FORCE GENERATING SHUNT

[75] Inventors: Jere L. McKee, Scott Twp., Lawrence County; Glenn R. Thomas, Brighton Township, Beaver County; Charles E. Haugh, Daughtry Twp., Beaver County; Lance Gula, Aliquippa, all of Pa.

[73] Assignee: Westinghouse Electric Corp., Pittsburgh, Pa.

[21] Appl. No.: 766,303

[22] Filed: Aug. 16, 1985

[51] Int. Cl.[4] ..... H01H 77/10

[52] U.S. Cl. ..... 335/16; 335/195

[58] Field of Search ..... 335/16, 195

[56] References Cited

U.S. PATENT DOCUMENTS 4,281,303 7/1981 Heft ..... 335/16

*Primary Examiner*—Harold Broome

*Attorney, Agent, or Firm*—L. P. Johns

[57] ABSTRACT

A circuit breaker with a force generate shunt characterized by a circuit breaker structure between spaced conductors with a fixed contact on one conductor and a movable contact on a contact arm that is movable between open and closed positions. A flexible shunt connected between the arm and the other conductor which shunt includes folded-over shunt portions that generate repulsion magnetic forces for pressing the closed contacts together and for expediting the contact arm open.

5 Claims, 3 Drawing Figures

CIRCUIT BREAKER WITH FORCE GENERATING SHUNT

CROSS-REFERENCE TO RELATED APPLICATIONS

This application is related to the copending application Ser. No. 818,947, filed Jan. 15, 1986, entitled "Circuit Breaker With Shock Resistant Latch Trip Mechanism" of J. L. McKee and G. R. Thomas, assigned to the present assignee.

BACKGROUND OF THE INVENTION

1. Field of the Invention

This invention relates to circuit breakers and, more particularly, to circuit breakers having a force generating shunt for facilitating opening of contacts while maintaining contact pressure in opposition to contact repulsion forces for permitting a higher withstand.

2. Description of the Prior Art

Current limiting circuit breakers are used to limit fault currents. More particularly, they reduce to tolerable levels both the peak fault currents and thermal energy that reach downstream equipment. Mechanical and magnetic forces that can destroy equipment are proportional to the square of the peak currents $(I_p)^2$, and thermal damage is proportional to the let through energy ($I^2t$). Moreover, current limiting circuit breakers not only perform the function of a circuit breaker and current limiting fuse, but are also resettable and reusable. These devices can also be effectively applied to motor control as well as to power distribution systems.

Two major factors control how well the current limiting phenomenon occurs; namely, how quickly the contacts separate after initiation of a fault current, and how quickly the impedance of the air arc develops, i.e., as the contacts separate an arc is drawn between them. The success of arc limiting requires a very high contact opening speed. The faster the contacts separate after initiation of the fault current, the shorter the dwell time of the arc acting on the contacts. Thus, the volume of melting and volatilization of the contact material is minimized.

SUMMARY OF THE INVENTION

In accordance with this invention it has been found that a circuit breaker may be provided which comprises an electrically insulating housing supporting a line conductor and a load conductor; an arc quenching chamber within the housing; a circuit breaker structure within the housing and between the conductors and comprising first and second separate contacts operable between open and closed positions within the quenching chamber; a releasable mechanism movable when released to a tripped position to effect automatic opening of the contacts and comprising a trip device for tripping the releasable mechanism when a predetermined current overload effects deflection of the device from a latch position; means carrying the first contact and including a switch arm and a contact arm, the switch arm being pivotally mounted at a first pivot for movement between open and closed positions of the contacts; the contact arm mounting the first contact and being pivotally mounted at a second pivot point on this switch arm between the first pivot and the first contact; the second contact being mounted on one of the line and load conductors; a flexible shunt electrically connected between the other of the line and load conductors and the contact arm on the side of the second pivot opposite the first contact; the flexible shunt comprising turned-back shunt portions spaced to form a loop and between which portions first repulsion magnetic forces occur that exert pressure on the contact arm to hold the contacts in the closed position; and the repulsion magnetic forces of the shunt portions expediting movement of the carrying means about the first pivot to the open position when the trip device is deflected from a latched position.

The circuit breaker of this invention has advantages of providing a force generating shunt used with a "blow-open" contact arm which aids in maintaining contact pressure while exciting a force to assist in forcing the contact arm open. Where the shunt structure is used in a molded case circuit breaker, it exerts a force which opposes the contact repulsion forces, thereby enabling higher withstand ratings.

DESCRIPTION OF THE PREFERRED EMBODIMENT

Figure 1:
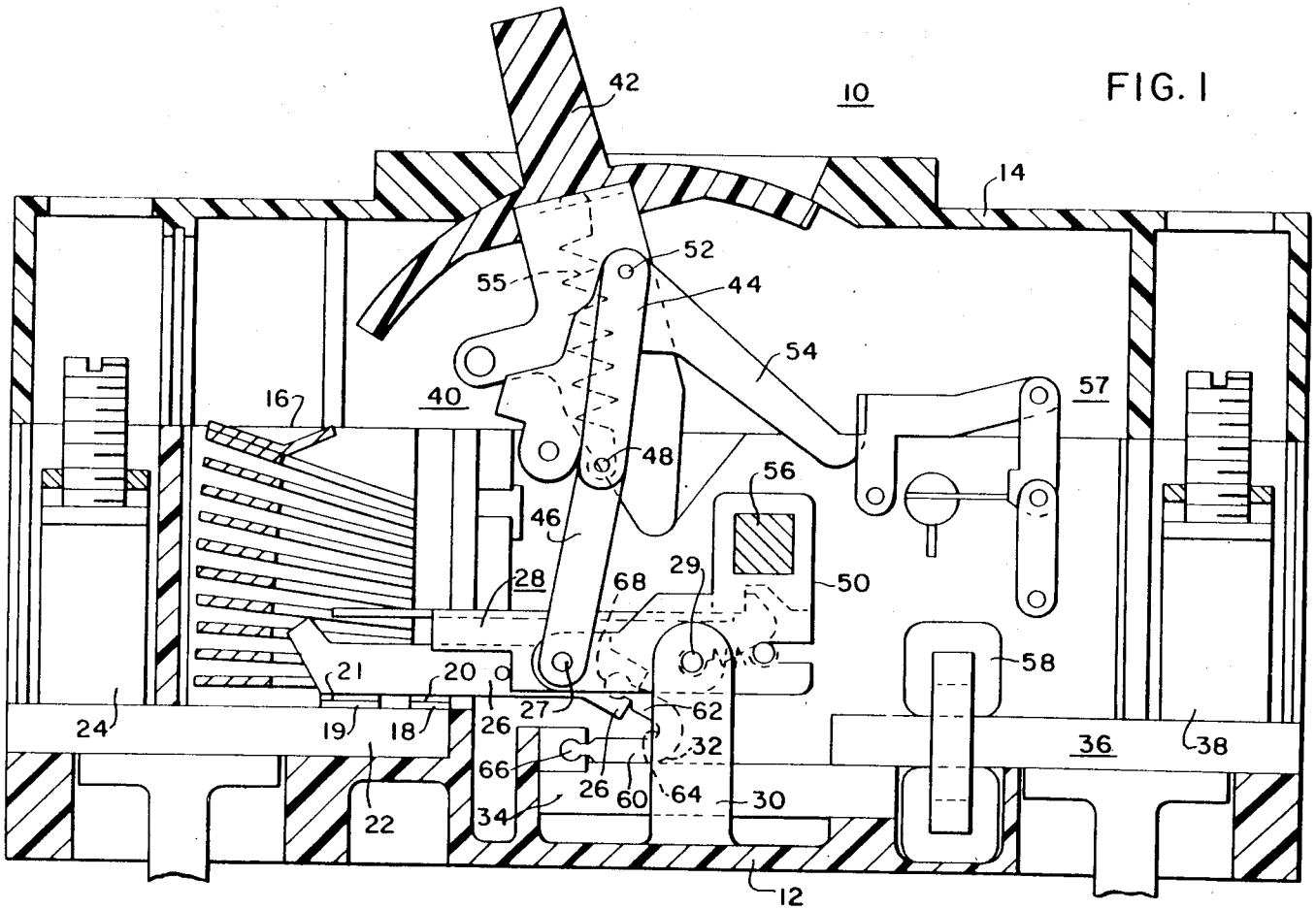
FIG. 1 is a vertical sectional view through a circuit breaker in a contact closed position and showing the shunt of this invention.

A molded case circuit breaker is generally indicated at 10 in FIG. 1 and it comprises a housing base 12 having a cover 14. The casing and the cover are assembled at a parting line 16 and create an internal compartment in which circuit breaker apparatus is disposed which includes a fixed main contact 18 and a movable main contact 20. Fixed and movable arcing contacts 19 and 21 respectively, are also provided. The fixed contacts 18, 19 are mounted on a conductor 22 to which a terminal 24 is connected.

Figure 2:
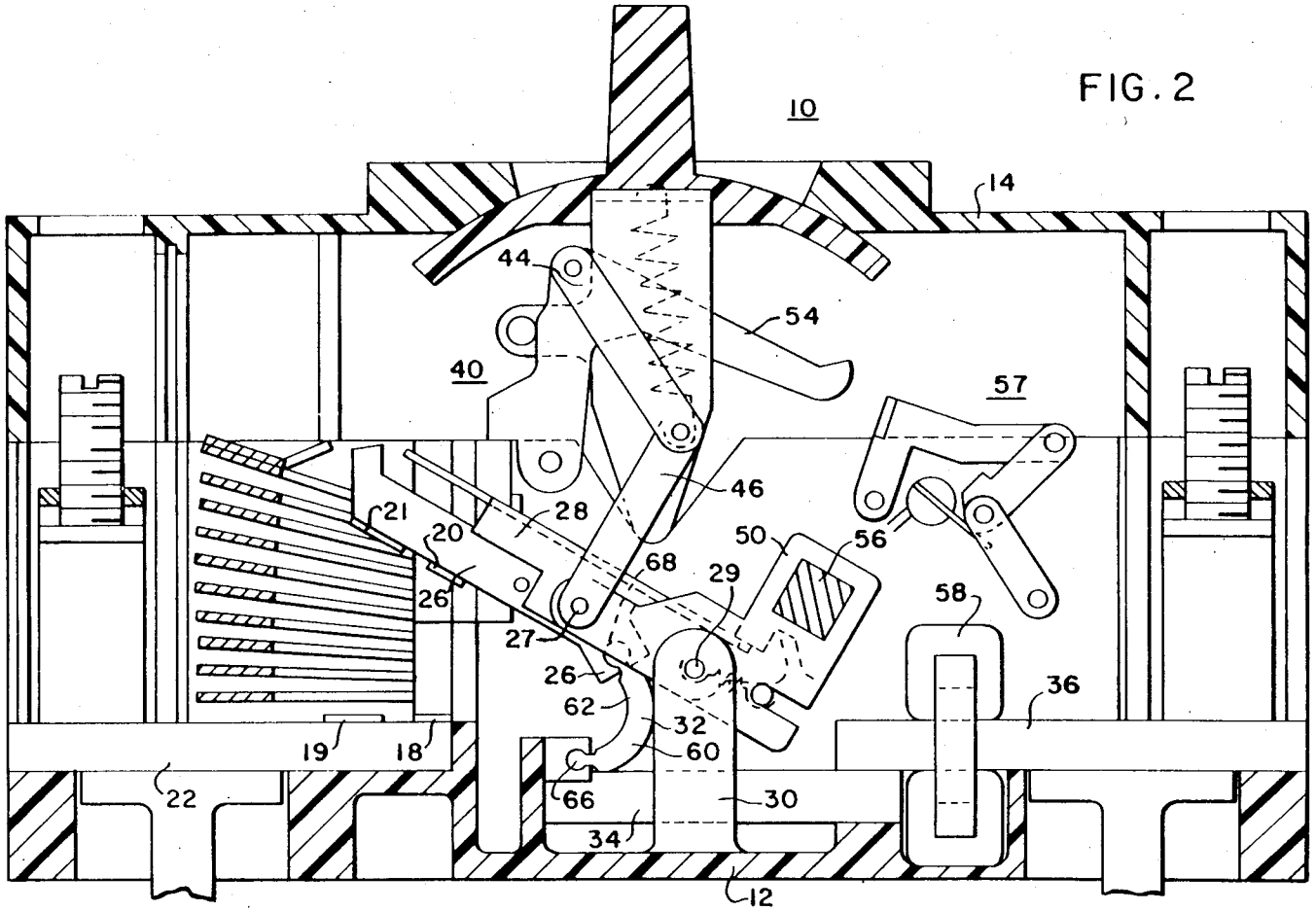
FIG. 2 is a vertical sectional view through the circuit breaker in the tripped position.

The movable contacts 20, 21 are mounted on a contact carrying arm 26 which is pivotally mounted at pivot 27 on a switch arm 28 (FIG. 2). The switch arm 28 in turn is pivotally mounted at pivot 29 on a housing frame member 30. A flexible conductor or shunt 32 extends from the arm 26 to a connector 34 of a conductor 36 which leads to a terminal 38. Although current flows through the circuit breaker extends from terminal 38 through the several parts 36, 34, 32, 26, 20, 18, 22 to the terminal 24, the circuit breaker also operates where the current direction is reversed.

An operating mechanism generally indicated at 40 is provided for opening and closing the contacts by means of a conventional toggle assembly which includes toggle links 44, 46 that are pivotally interconnected at a pivot 48. The link 46 is pivotally connected at pivot 27 to a rotatable bracket 50. The pivot 27 is aligned with and separate from the pivot 27 on the switch arm 26. The bracket 50 is pivotally mounted on the pivot 29. The link 46 is pivotally connected at pivot 52 to a releasable arm or cradle 54. The toggle mechanism also includes a coil spring 55 in a conventional manner. For a more complete description of the toggle mechanism, reference is made to U.S. Pat. No. 3,949,331 which is incorporated herein by reference.

Opening of the contacts 18, 20 is accomplished either by a handle 42 of the operating mechanism 40, or automatically tripped in response to over-current conditions occurring in the circuit. In the tripped position, the contact arm 26 is disposed in the position shown in FIG. 2. The bracket 50 supports a crossbar 56 which is interconnected with contact arms in adjacent pole units of a three pole circuit breaker for opening and closing corresponding contacts similar to the contacts 18, 20, simultaneously. Accordingly, when the operating mechanism 40 actuates the contact arm 26 between either open or closed positions, the contact arms in adjacent poles of the circuit breaker are moved correspondingly by the operating mechanism.

Automatic opening, or tripping, of the contacts is provided by a latching device generally indicated at 57 which may be actuated by an overload sensing device, such as bimetal strip 58 (FIG. 1). Operation of the latching device 57 is set forth in copending application mentioned above.

In accordance with this invention, the shunt 32 is comprised of shunt portions 60, 62 which are bent, or turned back, or folded over at an apex 64 to form a loop, V-shaped, or U-shaped configuration. One end of the shunt portion 60 is mounted at 66 to the connector 34 and the other end of the shunt is mounted at 68 on the contact arm 26. Since the current flow in the shunt 32 and the conductor 34 are in opposite directions, an electromagnetic force is generated therebetween to push the shunt upwardly against the contact arm 26. Inasmuch as the upper end of the shunt 32 is mounted at 68 on the side of the pivot 27 opposite the movable contact 21, the contact arm 26 rotates counterclockwise about the pivot 27 and thereby maintains contact pressure by opposing the action of a contact repulsion force that normally existing between the contacts 18, 20. Thus, contact blow-off, occurring in conventional circuit breakers, is avoided until such time as the latch device 57 is tripped to open the breaker, whereby higher withstand ratings are available.

When an overcurrent of low order occurs, the current transformer 58 actuates the latching device 57 through a solid state trip unit to release the cradle 54 (FIG. 2), whereby the toggle mechanism trips the circuit breaker by rotating the bracket 50. The shunt 32 withstands these lower current overloads.

Figure 3:
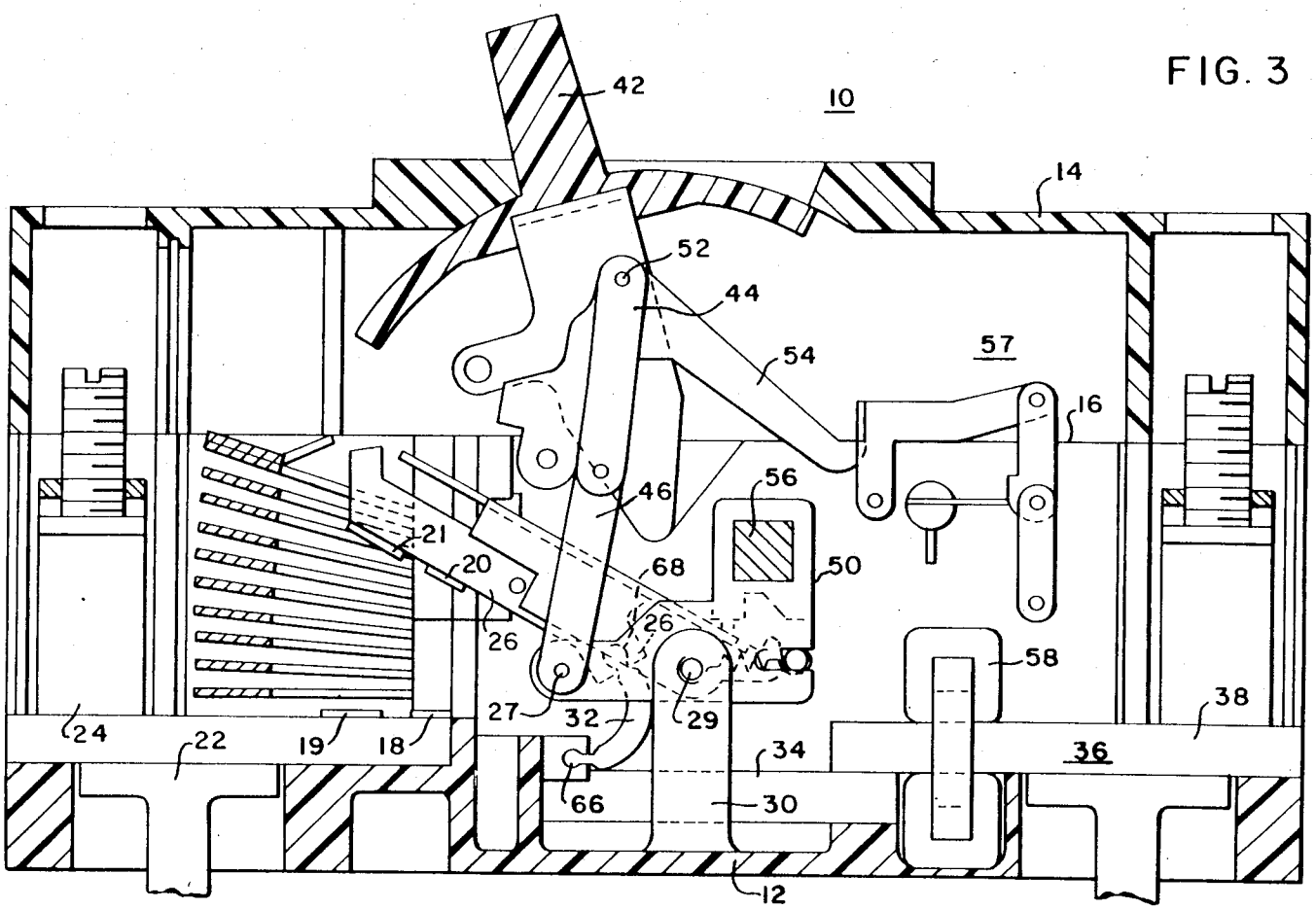
FIG. 3 is a vertical sectional view showing the circuit breaker in a blown apart position.

However, when an overcurrent of high order occurs, the shunt 32 responds immediately by rotating the assembly of the switch arm 28 and contact arm 26 about the pivot 29 to a "blown open" position (FIG. 3). Momentarily, the bracket 50 remains unmoved as in FIG. 3; or as in the same position as that of FIG. 1. This happens because of a rapid increase in repellant electromagnetic forces incurred between the oppositely directed shunt portions 60, 62. Since these forces exceed the forces that are normally sustained by the shunt portions, such as at normal, or low-order overcurrents, the portions 60, 62 are literally blown apart to the shape shown in FIGS. 2 and 3.

Shortly thereafter, such as of the order of a fraction of a current cycle, the current transformer 58 in response to the high order overcurrent, actuates the latching device 57 through a solid state trip unit (not shown). This causes the operating mechanism 40 to trip the circuit breaker and thereby rotate the bracket 50 to the position of FIG. 2.

By virtue of this construction lower current limiting threshold currents than are possible otherwise are provided by the flexible shunt 32 of this invention.

Accordingly, the shunt design of this invention generates a force which when used with a "blow-open" contact arm, aids in maintaining contact pressure while exerting a force to assist in opening the contact arm when necessary. Moreover, where the shunt design is used in a molded case circuit breaker it exerts a force which opposes the contact repulsion forces to enable higher withstand ratings.

What is claimed is:

1. A circuit breaker comprising:

an electrically insulating housing supporting a line conductor and a load conductor;

a circuit breaker structure within the housing and between the conductors and comprising first and second separable contacts operable between open and closed positions;

a releasable mechanism movable when released to a tripped position to effect automatic opening of the contacts and comprising a trip device for tripping the releasable mechanism when a predetermined current overload effects deflection of the device from a latched position;

carrying means carrying the first contact and including a switch arm and a contact arm, the switch arm being pivotally mounted at a first pivot for movement between open and closed positions of the contacts;

the contact arm mounting the first contact and being pivotally mounted at a second pivot on the switch arm;

the second contact being mounted on one of the line and load conductors;

a flexible shunt electrically connected between the other of the line and load conductors and the contact arm on the side of the second pivot opposite the first contact;

the flexible shunt comprising turned-back shunt portions spaced to form a loop and between which portions first repulsion magnetic forces occur that exert pressure on the contact arm to hold the contacts in the closed position; and the repulsion magnetic forces of the shunt portions expediting movement of the carrying means about the first pivot to the open position when at least one of the contact arms and the trip device is deflected from a latched position.

2. The circuit breaker of claim 1 in which the contact arm is pivotally mounted at the second pivot on the switch arm between the first pivot and the first contact.

3. The circuit breaker of claim 2 in which the flexible shunt has a substantially V-shaped configuration when the contacts are closed.

4. The circuit breaker of claim 2 in which the flexible shunt has a substantially U-shaped configuration when the contacts are closed.

5. The circuit breaker of claim 1 in which the shunt portion and the conductor to which the portion is connected are substantially parallel and thereby generate second repulsion magnetic forces which complement the first repulsion forces to generate a greater pressure on the carrying means.

* * * * *